US009899155B2

(12) United States Patent
Ehrlich

(10) Patent No.: US 9,899,155 B2
(45) Date of Patent: Feb. 20, 2018

(54) SWITCHING ARRANGEMENT AND METHOD FOR MOUNTING A SWITCHING ARRANGEMENT

(71) Applicant: SIEMENS AKTIENGESELLSCHAFT, Munich (DE)

(72) Inventor: Frank Ehrlich, Hohen Neuendorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/037,058

(22) PCT Filed: Oct. 27, 2014

(86) PCT No.: PCT/EP2014/073020
§ 371 (c)(1),
(2) Date: May 17, 2016

(87) PCT Pub. No.: WO2015/074839
PCT Pub. Date: May 28, 2015

(65) Prior Publication Data

US 2016/0307709 A1 Oct. 20, 2016

(30) Foreign Application Priority Data

Nov. 20, 2013 (DE) ..... 10 2013 223 632

(51) Int. Cl.

| | |
|---|---|
| ***H01H 1/06*** | (2006.01) |
| ***H01H 33/70*** | (2006.01) |
| ***H01H 9/02*** | (2006.01) |
| ***H01H 11/04*** | (2006.01) |

(Continued)

(52) U.S. Cl.
CPC ..... *H01H 1/06* (2013.01); *H01H 9/02* (2013.01); *H01H 11/04* (2013.01); *H01H 33/7061* (2013.01); *H01H 1/385* (2013.01); *H01H 33/74* (2013.01)

(58) Field of Classification Search
CPC . H01H 1/06; H01H 9/02; H01H 11/04; H01H 33/7061; H01H 1/385; H01H 33/74
USPC ..... 200/275; 439/181, 188; 218/59, 63, 79, 218/84
See application file for complete search history.

(56) References Cited

U.S. PATENT DOCUMENTS

| | | | |
|---|---|---|---|
| 6,271,494 | B1 | 8/2001 | Dienemann et al. |
| 6,730,871 | B1 | 5/2004 | Loebner |

(Continued)

FOREIGN PATENT DOCUMENTS

| | | | |
|---|---|---|---|
| CN | 101111915 | A | 1/2008 |
| CN | 101425426 | A | 5/2009 |

(Continued)

*Primary Examiner* — Edwin A. Leon
(74) *Attorney, Agent, or Firm* — Laurence Greenberg; Werner Stemer; Ralph Locher

(57) ABSTRACT

A switching arrangement includes an interrupter unit with a first and a second switching contact piece. A switching path can be formed between the two switching contact pieces under a relative movement of the same. At least one of the switching contact pieces is arranged within a hollow body. The switching contact piece is supported by a transversal crosspiece that crosses the hollow body. The transversal crosspiece is braced at opposite sections of the hollow body.

16 Claims, 3 Drawing Sheets

(51) Int. Cl.
*H01H 1/38* (2006.01)
*H01H 33/74* (2006.01)

(56) References Cited

U.S. PATENT DOCUMENTS

| | | | | |
|---|---|---|---|---|
| 7,384,287 | B2 * | 6/2008 | Hughes | H01H 9/085 439/181 |
| 7,572,133 | B2 * | 8/2009 | Hughes | H01H 33/66207 439/181 |
| 8,674,253 | B2 * | 3/2014 | Uchii | H01F 27/321 218/59 |
| 2003/0127430 | A1 | 7/2003 | Iwabuchi et al. | |
| 2007/0295693 | A1 | 12/2007 | Saxl et al. | |
| 2009/0107957 | A1 | 4/2009 | Drews et al. | |
| 2012/0085735 | A1 | 4/2012 | Uchii et al. | |
| 2013/0126481 | A1 | 5/2013 | Ozil et al. | |
| 2013/0270228 | A1 | 10/2013 | Nakada et al. | |

FOREIGN PATENT DOCUMENTS

| | | | |
|---|---|---|---|
| CN | 102460870 | A | 5/2012 |
| CN | 103109339 | A | 5/2013 |
| CN | 103201809 | A | 7/2013 |
| DE | 4333277 | C2 | 7/1995 |
| EP | 1226597 | B1 | 1/2004 |
| JP | H0997543 | A | 4/1997 |

* cited by examiner

SWITCHING ARRANGEMENT AND METHOD FOR MOUNTING A SWITCHING ARRANGEMENT

BACKGROUND OF THE INVENTION

Field of the Invention

The invention relates to a switching arrangement having an interrupter unit which has a first and a second switching contact piece, wherein the two switching contact pieces can be moved relative to one another so as to form a switching path and at least one of the switching contact pieces is positioned within a hollow body, in particular within a rotationally symmetrical hollow body.

A switching arrangement of this kind is known, for example, from European patent EP 1 226 597 B1. Said document describes a switching arrangement having an interrupter unit which has a first and a second switching contact piece. The two switching contact pieces can be moved relative to one another so as to form a switching path, wherein one of the switching contact pieces is arranged within a hollow body. In this case, the hollow body extends in a substantially rotationally symmetrical manner in relation to a rotation axis.

The known arrangement is described in a highly abstract manner. The known switching arrangement does not indicate how a cost-effective connection of the switching contact piece which is to be positioned within the hollow body would be implemented in practice.

BRIEF SUMMARY OF THE INVENTION

Therefore, the object is to specify a suitable construction for positioning the switching contact piece.

According to the invention, the object is achieved with a switching arrangement of the kind mentioned in the introductory part in that the switching contact piece is supported by means of a cross member which crosses the hollow body and is clamped to opposite sections of the hollow body.

The switching contact piece which is to be positioned within a hollow body can be, for example, a rated current contact piece or an arc contact piece. The hollow body can be, for example, an encapsulation housing which surrounds the interrupter unit. However, provision can also be made for the hollow body to be, for example, a current path section, for example of the interrupter unit, which serves to supply an electric current to the switching contact piece which is positioned within the hollow body. If a cross member is now used, said cross member being clamped to opposite sections of the hollow body, it is possible to form the hollow body, for example, by a semi-finished product, wherein the cross member is subsequently connected to the hollow body at a fixed angle. It is possible to position the switching contact piece in the interior of the hollow body by means of the cross member. The hollow body and the switching contact piece can preferably be arranged in such a way that they are oriented substantially coaxially in relation to one another. For example, the hollow body can be a rotationally symmetrical and/or hollow-cylindrical hollow body, wherein the switching contact piece, for its part, can be a rotation body and/or cylindrical body, so that the rotation axes/cylinder axes of the hollow body and the switching contact piece are oriented preferably coaxially in relation to one another after said switching contact piece is mounted on the cross member. A cross member can extend in the manner of a web through a hollow recess in the hollow body between sections of a wall of the hollow body which are oriented in opposite directions in relation to one another. The cross member is intended to be supported against the hollow body at the end, preferably on both sides. As a result of the cross member making contact with a wall of the hollow body, it is further possible to form an electrical current path from the hollow body to the cross member. To this end, the hollow body can be produced, for example, from an electrically conductive material. Furthermore, the cross member can advantageously be of electrically conductive design, so that a current path is formed from the hollow body, via the cross member, to the switching contact piece which is mounted on the cross member. The hollow body and the cross member should in this case permanently carry the same electrical potential, it being possible to achieve this, for example, by electrical contact being made between the hollow body and the cross member in at least one of the end regions of the cross member. Therefore, it is possible, for example, to use the hollow body as the current path and to continue the electrical current path to the switching contact piece, which is supported against the cross member, via the cross member. Therefore, it is possible to make electrical contact with the hollow body outside said hollow body and to form a current path via the cross member to the switching contact piece in the interior of the hollow body. The cross member can be of rod-like design, for example of substantially cuboidal design or substantially of rotationally symmetrical design, wherein a rotationally symmetrical cross member can also have flat regions on the lateral surface in order to receive, for example, the switching contact piece. To this end, the cross member can have, for example, cross section-reducing recesses or integral formations which result in a corresponding increase in cross section. In this case, the switching contact piece can serve, for example, as an arc contact piece and can be arranged such that it can move relative to the hollow body. However, provision can also be made for the switching contact piece to be positioned at a fixed angle in relation to the hollow body. For its part, the hollow body can serve as a rated current contact piece of the switching contact piece which is positioned in the interior of said hollow body. Therefore, it is possible, for example, to close the switching contact piece, which is arranged in the interior of the hollow body, with a further switching contact piece before respectively associated rated current contact pieces in the event of a connection process, and to open said switching contact piece following associated rated current contact pieces in the event of a disconnection process. Therefore, possible arcs in the event of connection or disconnection of a current path are passed to the switching contact pieces in a targeted manner.

A further advantageous refinement can make provision for the hollow body to be a hollow cylinder.

Use of a hollow-cylindrical hollow body allows semi-finished products to be used, this being cost-effective, in order to use a current supply to the switching contact piece which is arranged in the interior of the hollow body. A hollow cylinder can also be used, for example, in order to form a structure of which the length can be changed in a telescopic manner. Furthermore, a hollow-cylindrical structure provides a continuous inner wall in the hollow cylinder. In the axial course, the cross member can be clamped in various positions along the cylinder axis of the hollow body.

The cross member can be clamped, for example, in a force-fitting or interlocking manner, so that the cross member can be mounted in a simple manner. Furthermore, it is possible to replace the cross member. This results in a switching arrangement which is easy to repair.

Provision can advantageously be made for the cross member to lie on a diameter of the hollow body.

The arrangement of the cross member on a diameter of a hollow body with an envelope contour which is circular in projection means it is possible to position the switching contact piece in a relatively arbitrary manner in the interior of the hollow body. In particular, the switching contact piece can be positioned in a coaxial manner in the case of a rotationally symmetrical design of the hollow body and the switching contact piece. The switching contact piece can, for its part, be designed in the manner of a bolt for example, wherein a bolt longitudinal axis should be oriented coaxially in relation to the rotation axis/cylinder axis of the hollow body. This results in a dielectrically expedient design in order to form an interrupter unit. Interrupter units of this kind can be used, for example, in high- and extremely high-voltage ranges too. Positioning the cross member on a diameter further makes it possible to position the switching contact piece in an eccentric manner on the cross member too. This results in a larger variance in the case of a combination of hollow body and cross member. Furthermore, positioning of the cross member on a diameter is advantageous in order to distribute clearances remaining between the cross member and the inner wall of the hollow body symmetrically around the cross member. Therefore, it is possible, for example, to use the hollow body in order to conduct, for example, fluids such as switching gases or insulating gases in the interior of the hollow body and to allow said fluids to flow around the cross member. This allows, for example, improved cooling of the switching contact piece which is mounted on the cross member and of the cross member itself. Thermal energy can be transported through a fluid flowing in the interior of the hollow body in a simplified manner. Improved heat dissipation allows a greater current-carrying capacity, and therefore larger currents can also be transported from the hollow body, via the cross member, to the switching contact piece.

A further advantageous refinement can make provision for the first switching contact piece to be arranged in a rod-like manner coaxially in relation to the cylinder axis of the hollow cylinder.

A rod-like first switching contact piece is provided, for example, with a circular cross section, wherein a contact-making region of the first switching contact piece is located at a free end of the first switching contact piece. Positioning coaxially in relation to the cylinder axis makes it possible either to move the first switching contact piece relative to the hollow cylinder or to allow movement of a second switching contact piece relative to the first switching contact piece. A coaxial arrangement further constitutes a dielectrically stable construction.

A further advantageous refinement can make provision for the first switching contact piece to be seated on the cross member at the end.

Connection of the first switching contact piece to the cross member at the end allows the, in particular rod-like, cross member and the first switching contact piece to be oriented substantially perpendicular in relation to one another, so that only a small bearing region has to be provided between the switching contact piece and the cross member in order for the cross member to make contact. This provides possibilities for cross section-reducing hollow bodies which extend substantially coaxially in relation to a rotation axis.

A further advantageous refinement can make provision for the cross member and the first switching contact piece to be screw-connected.

Screw-connection of the cross member and the first switching contact piece allows discrete assemblies to be formed, wherein, depending on the design of the switching arrangement, various cross members and various first switching contact pieces can be exchanged for one another. This results in a modular construction of the switching arrangement. Screw-connection further has the advantage that the first switching contact piece and the cross member are connected to one another in a releasable manner and when, for example, the first switching contact piece wears out, for example owing to the occurrence of switching arcs, the first switching contact piece can be replaced.

A further advantageous refinement can make provision for the cross member to be screw-connected to the hollow body from the radial direction.

Screw-connection of the cross member facilitates the modular design concept of a switching arrangement. In this way, it is possible to screw-connect the hollow body to the cross member and to screw-connect the cross member, for its part, to the first switching contact piece. Therefore, the variance of the combination of an extremely wide variety of cross members, an extremely wide variety of first switching contact pieces and an extremely wide variety of hollow bodies is increased and furthermore the ease of repair of the switching arrangement is improved. Clamping by means of screws has the advantage that forces for clamping the cross member, for example from the outer surface of the hollow body, can be applied from the radial direction. By way of example, provision can be made, for the purpose of screw-connection of the cross member, of a recess which passes through a hollow body wall and in which a bolt can be inserted for screw-connection purposes. As a result, the ability to mount the cross member within the hollow body is further improved since no actions have to be taken in the interior of the hollow body for the purpose of screw-connecting the cross member. By way of example, dimples can be provided on the recess, so that bolt heads and nuts also terminate dielectrically flush in the outer surface of the hollow body.

A further advantageous refinement can make provision for the cross member to be connected to the hollow body by a tenon and mortise joint.

The cross member can be provided with a corresponding tenon which engages in a dimensionally complementary manner into a recess in the hollow body. In this way, it is possible to fix the position of the cross member within the hollow body in a simple manner. Furthermore, the size of the surface region which is provided for establishing contact between the cross member and the hollow body is increased by a tenon and mortise joint. A tenon of a cross member can project, for example, into a slot (recess) in the hollow body and can be clamped there, for example, by means of a bolt. By virtue of corresponding shaping of the tenon and of the slot which receives the tenon for example, the cross member can also be positively guided on the hollow body, so that, for example, the relative position of the cross member and the hollow body is unambiguously defined. Tenons can have, for example, substantially rectangular profiles which engage into corresponding grooves or recesses with a dimensionally complementary profile.

A further advantageous refinement can make provision for the cross member to be inserted into the interior of the hollow body through a recess in the lateral surface, and for a tenon of the cross member to be pivoted into a slot.

A cross member can be inserted into the interior of the hollow body via a recess in the lateral surface, for example. In this case, the recess can be oriented substantially radially in relation to a rotation axis of the hollow body, so that the cross member is oriented substantially perpendicular in relation to the rotation axis of the hollow body. A tenon of the cross member can ensure a dimensionally complementary connection between the cross member and the hollow body by means of a slot. If the recess is now used and said recess is connected to a slot into which the tenon is pivoted, a mounting movement can be performed initially in the radial direction with respect to the rotation axis of the hollow body, wherein pivoting, for example about the rotation axis, can be performed. Therefore, mounting is possible in one operation and a unique angular position between the cross member and the hollow body can also be maintained owing to the dimensionally complementary configuration of the tenon and the slot. In this way, it is possible in a simple manner to force a constrained position for the first switching contact piece which is to be supported against the cross member.

Furthermore, provision can advantageously be made for a bolt to be clamped to the cross member such that it is supported against cheeks of the slot.

It is possible to clamp the cross member with the hollow body by means of a bolt. Cheeks of the slot can be used in order to support the bolt or a bolt head/a nut and to produce a clamping moment between the cross member and the hollow body. By way of example, the bolt can generate a moment of force in the radial direction in relation to the rotation axis of the hollow body.

A kind of bayonet fitting of the cross member in the hollow body can be achieved by pivoting a tenon into a slot. In this way, it is possible, for example, to limit axial mobility of the cross member. The location of the bayonet-type fitting can be ensured by clamping the cross member and the hollow body.

Furthermore, provision can advantageously be made for the slot to open out into the recess.

If the slot and the recess merge, it is possible firstly to use the recess in order to move the cross member into the interior of the hollow body and, at the same time, to deflect the cross member out of the recess and to allow the cross member to slide over into the slot. To this end, the recess should advantageously have a greater extent than the slot, for example the extent in a direction which is transverse to the pivot plane should be greater than the extent of the slot. The slot can be designed as part of the recess.

A refinement of this kind makes it possible to use the slot, for example, as a rotation-prevention means for the cross member. By way of example, the cross member can have a circular-cylindrical cross section, the cross section of the recess being selected to correspond to said circular-cylindrical cross section. The slot in turn has smaller dimensions in order to permit tenons which are formed, for example, in a blade-like manner at the ends to slide into the slot in each case. A rotation-prevention means in the slot can additionally be realized by virtue of a plate-like blade shape of the tenons.

A further object of the invention is to specify a method for mounting a cross member for supporting a switching contact piece in the interior of an, in particular rotationally symmetrical, hollow body of an interrupter unit of a switching arrangement.

According to the invention, provision is made in a method of the abovementioned type for the cross member to be inserted into the interior of the hollow body through a recess in the lateral surface, and for a tenon of the cross member to be pivoted into a slot.

As a result of a tenon being pivoted into a slot, the position of the cross member on the hollow body can be ensured in the first instance. By way of example, in the case of a cross member which extends substantially in the manner of a bolt, the end sides can be designed with a reduced cross section, so that tenons are produced. These tenons can be pivoted into corresponding slots in the hollow body by rotation of the cross member. As a result of the pivoting-in process, the cross member can be prevented from sliding out in the radial direction with respect to the rotation axis of the hollow body. Shoulders which adjoin the tenon can prevent this by said shoulders being supported against the inner-wall surface of the hollow body. In addition, the axial position of the cross member on the hollow body can also be ensured.

In one method, provision can advantageously further be made for the cross member to be pivoted about a rotation axis of the hollow body.

Pivoting about a rotation axis of the hollow body allows a cross member to be inserted into the interior of the hollow body, initially from the radial direction from outside through a recess, and there to itself pivot about the rotation axis of the hollow body, so that the cross member moves out of the recess in the wall, which recess served for insertion of the cross member, and instead a tenon is inserted into a slot-like recess. By way of example, slot-like recesses can also be in the form of grooves or continuous apertures in a lateral surface wall of the hollow body. Owing to the pivoting process, the cross member is locked in the hollow body and in this way preferably prevented from moving in an axial manner, possibly also from moving in a radial direction.

A further advantageous refinement can make provision for the cross member to be clamped to the slot.

Clamping the cross member to the slot allows the cross member to be prevented from undesirably moving backward when the end position of said cross member is reached (locking position). Clamping can be performed, for example, by means of threaded bolts. However, clamping can also be performed in another way, for example by clamping screws or the like. Clamping firstly secures the position of the cross member relative to the hollow body and secondly clamping can also establish a contact pressure between the cross member and the hollow body, so that a contact resistance between the hollow body and the cross member is comparatively low. This provides the possibility of integrating the cross member in a current path which serves to supply an electric current to the switching contact piece which is positioned in the interior of the hollow body. A switching contact piece can advantageously be clamped to the cross member after the cross member has been clamped.

BRIEF DESCRIPTION OF THE SEVERAL VIEWS OF THE DRAWING

An exemplary embodiment of the invention is schematically shown below in a drawing and described in more detail in the text which follows. In the drawing.

DESCRIPTION OF THE INVENTION

Figure 1:
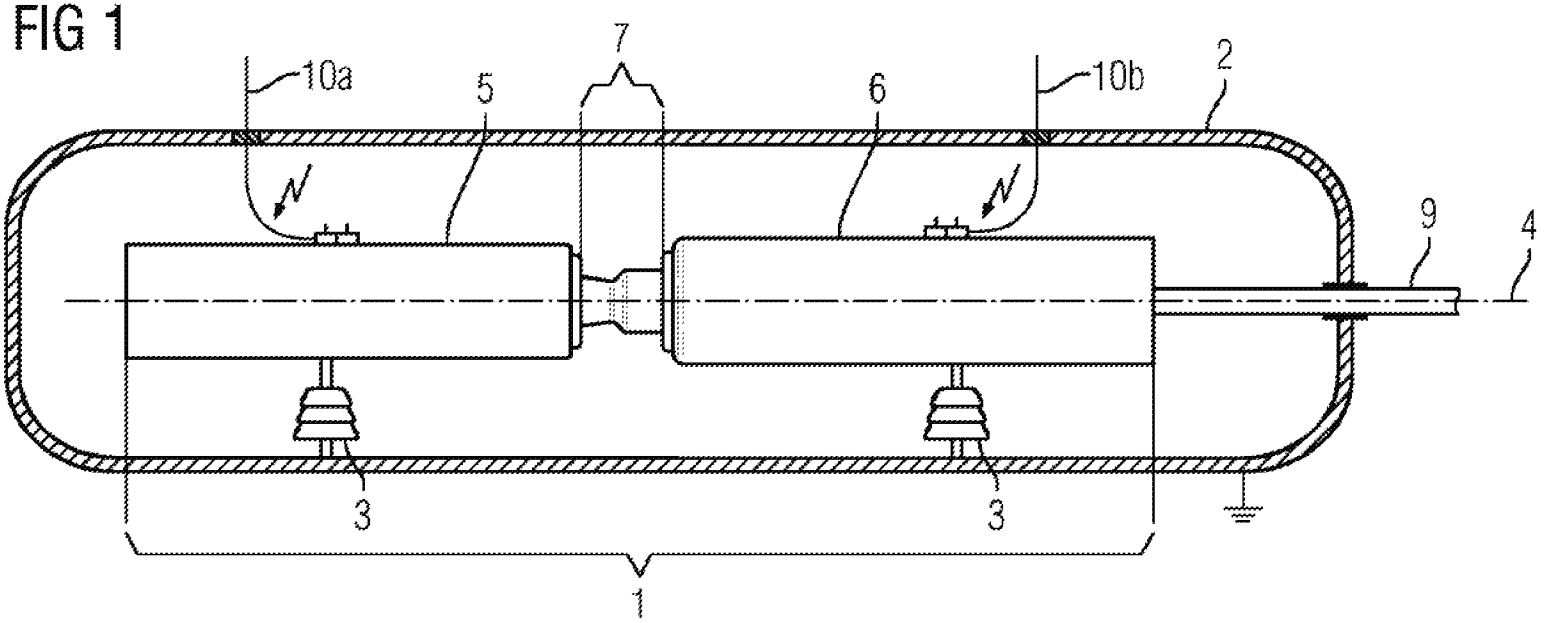
FIG. 1 shows an external view of an interrupter unit in an encapsulation housing.

FIG. 1 shows an external view of an interrupter unit 1, as can be arranged within an encapsulation housing 2. In the present case, the encapsulation housing 2 is formed from an electrically conductive material, for example cast aluminum, and carries ground potential. The encapsulation housing 2 is of fluid-tight design, so that an insulating medium can be encapsulated in the interior of the encapsulation housing 2. Fluids are suitable as insulating media. In particular, electrically insulating gases which are placed under excess pressure in the interior of the encapsulation housing 2 have stable electrical insulation properties. Sulfur hexafluoride, nitrogen, carbon dioxide in gaseous form can be used for example. However, substances of this kind can also be present at least partially or entirely in liquid form in the interior of the encapsulation housing 2. The electrically insulating fluid washes around and washes through the interrupter unit 1 which is arranged in the interior of the encapsulation housing 2.

The interrupter unit 1 is supported on the encapsulation housing 2 in a manner electrically insulated by means of post-type insulators 3. Electrical insulation from the encapsulation housing 2 is realized as a result, and therefore ground potential, for example, can be applied to said encapsulation housing. An arrangement of this kind is also called a dead tank arrangement since electrically active parts are accommodated entirely within an encapsulation housing 2 which is at a neutral electrical potential (ground potential). As an alternative, the encapsulation housing can also be of live tank design, wherein in this case the encapsulation housing is of substantially electrically insulating design and, for its part, performs a supporting and holding function for the interrupter unit 1 which is arranged within the encapsulation housing. An encapsulation housing of live tank design is to be kept electrically insulated for its part.

The interrupter unit 1 is of substantially rotationally symmetrical construction and is oriented along a rotation axis 4. The rotation axis 4, for example also in the case of a substantially rotationally symmetrical configuration of the encapsulation housing 2, is suitable for orienting the encapsulation housing 2 coaxially in relation to said rotation axis 4.

The interrupter unit 1 has a first hollow body 5 and a second hollow body 6. In the present case, the two hollow bodies 5, 6 are in the form of hollow cylinders which delimit the outer contour of the interrupter unit 1. A switching path (gap 7) of the switching arrangement extends between the two hollow bodies 5, 6. Accordingly, the two hollow bodies 5, 6 are electrically insulated from one another in the OFF position. An insulating material nozzle 8 passes through a gap 7 which is situated at the end between the two hollow bodies 5, 6. As an alternative, the gap 7 can also be bridged by further electrically insulating holding elements, such as insulating material tubes, insulating material rods or the like, which connect, for example, the two hollow bodies 5, 6 to one another at a fixed angle and orient said two hollow bodies such that they are in alignment. A drive rod 9 is inserted into the interior of the second hollow body 6 at that end of the second hollow body 6 which is averted from the gap 7. The drive rod 9 passes through a wall of the encapsulation housing 2 in a fluid-tight manner. It is therefore possible to generate a movement outside the encapsulation housing 1 and to introduce said movement into the interior of the interrupter unit 3 by means of the drive rod 9, so as to pass the encapsulation housing 2 in a fluid-tight manner.

Electrically conductive contact is made with the two hollow bodies 5, 6 by respective connection lines 10*a*, 10*b*. A current path can be disconnected and connected using the interrupter unit 1 by means of the connection lines 10*a*, 10*b*. The connection lines 10*a*, 10*b* are routed through the encapsulation housing 2 in an electrically insulated manner, so that integration of the interrupter unit 1 or the switching arrangement in an electrical power transmission system can be performed by means of the connection lines 10*a*, 10*b* outside the encapsulation housing 2. Integration of this kind can be implemented in a variety of ways, for example the connection lines 10*a*, 10*b* can be connected to overhead lines. However, provision can also be made for further encapsulation housings to be connected to the encapsulation housing 2 in order to route the connection lines 10*a*, 10*b* to further assemblies, possibly likewise in a pressure-insulated manner.

Figure 2:
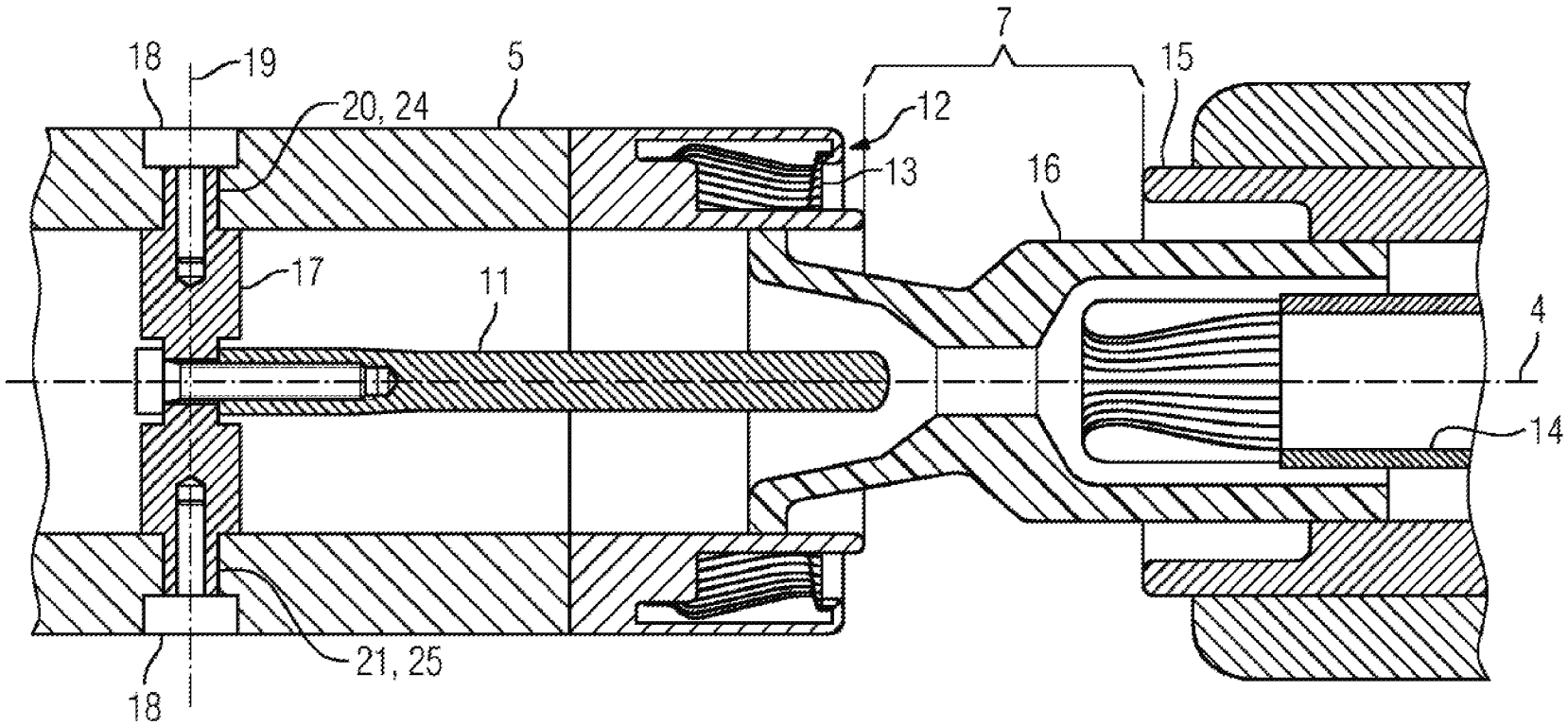
FIG. 2 shows a section through a hollow body together with a cross member of the interrupter unit.

Furthermore, the design in the interior of the two hollow bodies 5, 6 of the interrupter unit 1 will now be described in greater detail with reference to FIG. 2. To this end, a sectional illustration is shown in FIG. 2. The sectional illustration shows a detail of the first hollow body 5 which is of substantially hollow-cylindrical form and is oriented coaxially in relation to the rotation axis 4. FIG. 2 further shows a detail of the second hollow body 6, wherein the second hollow body 6 is likewise designed in the form of a hollow cylinder which is likewise oriented coaxially in relation to the rotation axis 4. The two hollow bodies 5, 6 are arranged at a distance from one another at the mutually facing end sides, wherein a gap 7 through which electrically insulating fluid flows is shown between the end sides of the two hollow bodies 5, 6. Both the second hollow body 6 and the first hollow body 5 are fixed in position. A first switching contact piece 11 and a first rated current contact piece 12 are arranged on the first hollow body 5. In this case, the first switching contact piece 11 is formed in the manner of a bolt and oriented coaxially in relation to the rotation axis 4. In this case, the cross section of the first switching contact piece 11 is smaller than the hollow recess in the first hollow body 5, so that the first hollow body 5 engages around the first switching contact piece 11 at a distance from the outer lateral surface. The first hollow body 5 is in the form of a first rated current contact piece 12 on that end side which faces the second hollow body 6. To this end, the first hollow body 5 is of multipartite design, wherein a plurality of flexible contact fingers 13 form a contact bushing at the end in order to form a contact region of the first rated current contact piece 12. The end side of the first switching contact piece 11 projects past the first rated current contact piece 12 in the direction of the second hollow body 6, so that the first switching contact piece 11 projects beyond the contact region of the flexible contact fingers 13 in the axial direction.

The second hollow body 6 is likewise of hollow-cylindrical design and formed coaxially in relation to the rotation axis 4. The second hollow body 6 is mounted in a fixed position, wherein a second switching contact piece 14 and a second rated current contact piece 15 are mounted in an axially displaceable manner with respect to the rotation axis 4 in the inner lateral surface region of said second hollow body. The second rated current contact piece 15 is supported against the inner lateral surface of the second hollow body 6 in a telescopic manner. In a region not illustrated in FIG. 2, both the second rated current contact piece 15 and the second switching contact piece 14 are connected to the drive rod 9, so that a common movement of the second switching contact piece 14 and of the second rated current contact piece 15 can be initiated by movement of the drive rod 9. The second hollow body 6 engages around the outer lateral surface of the second rated current contact piece 15. The second rated current contact piece 15 and the second hollow body 6 in turn engage around the second switching contact piece 14 for its part. Therefore, the second hollow body 6, the second switching contact piece 14 and the second rated current contact piece 15 are oriented coaxially in relation to the rotation axis 4, wherein the second rated current contact piece 15 and the second switching contact piece 14 are mounted in an axially displaceable manner with respect to the rotation axis 4. An insulating material nozzle 16 which is connected to the second rated current contact piece 15 at a fixed angle and spans the gap 7 in the disconnected state of the switching arrangement (see FIG. 1, see FIG. 2) can be moved together with the second rated current contact piece 15 and the second switching contact piece 14. The insulating material nozzle 16 is of rotationally symmetrical design and is oriented coaxially in relation to the rotation axis 4. By way of its end which projects in the direction of the first hollow body 5, the insulating material nozzle 16 is mounted in a sliding manner such that it bears against the first hollow body 5 by way of the inner casing surface, so that, in the event of a switching movement of the second rated current contact piece 15 and the second switching contact piece 14, the insulating material nozzle 16 can move together with said second rated current contact piece and second switching contact piece, wherein the insulating material nozzle 16 is guided against the inner wall of the first hollow body 5. In the present case, the second switching contact piece 14 is of substantially tubular design and has, at its end which faces the first switching contact piece 11, a bushing-like opening which the first switching contact piece 11 can enter in a dimensionally complementary manner. The second rated current contact piece 15 has a circular-cylindrical outer lateral surface onto which the flexible contact fingers 13 of the first rated current contact piece 12 can move. Analogously to the geometric arrangement of the first switching contact piece 11 and the first rated current contact piece 12, the contact region of the second switching contact piece 14 projects past the contact region of the second rated current contact piece 15 in the direction of the first hollow body 5. In the event of a connection process, this ensures that initially the two switching contact pieces 11, 14 make contact with one another and, thereafter, the two rated current contact pieces 12, 15 make contact with one another. In the event of disconnection, the two rated current contact pieces 12, 15 are initially disconnected and thereafter the two switching contact pieces 11, 14 are disconnected. This ensures that pre-arcing in the case of connection or disconnection arcs in the event of disconnection are preferably routed to the switching contact pieces 11, 14, so that the rated current contact pieces 12, 15 are protected against contact erosion.

A cross member 17 is provided in order to position the first switching contact piece 11 relative to the first hollow body 5. In the present case, the first switching contact piece 11 and the first rated current contact piece 12 are arranged fixed in position relative to one another. To this end, the first rated current contact piece 11 is screw-connected to the cross member 17. The cross member 17 is connected to the first hollow body 5 at a fixed angle such that it lies substantially on a diameter of said first hollow body. Therefore, the cross member 17 is oriented substantially perpendicular in relation to the rotation axis 4, wherein the longitudinal axis 19 of the cross member 17 preferably intersects the rotation axis 4.

The cross member 17 is supported against the wall of the first hollow body 5. To this end, the cross member 17 has tenons 20, 21 at each of its end sides, said tenons being mounted in dimensionally complementary slots 24, 25 in the first hollow body 5. In this case, the tenons 20, 21 engage in the slots 24, 25. The cross member 17 is clamped to the first hollow body 5 by means of bolts 18. The first hollow body 5 and the first switching contact piece 11 are electrically conductively contact-connected to one another by means of the cross member 17.

In addition to a connection of the cross member 17 and the first switching contact piece 11 at a fixed angle, provision can also be made for the cross member 17 to serve to at least partially mount a gear mechanism in order to allow, for example, movement of the first switching contact piece 11 relative to the first hollow body 5.

Figure 3:
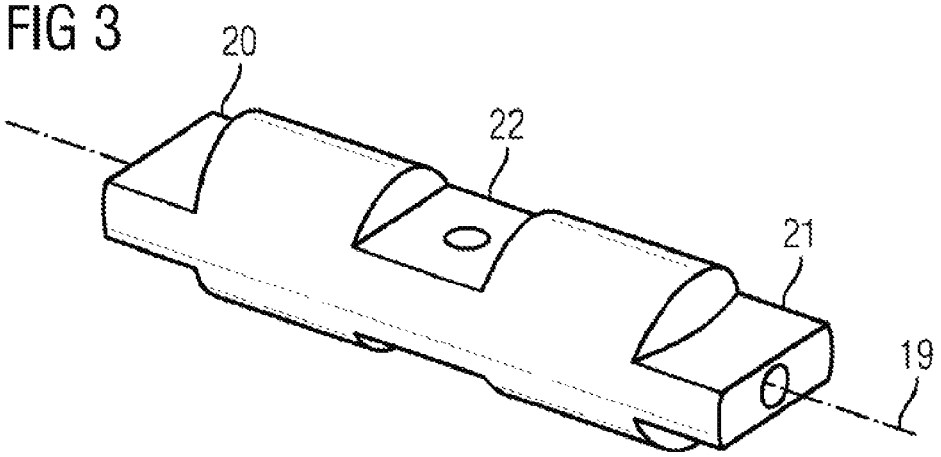
FIG. 3 shows a perspective view of a cross member.

The design of the cross member 17 is illustrated in FIG. 3. The cross member 17 is electrically conductive. It is clear from the perspective view that the cross member 17 is produced from a cylindrical main body. In the present case, the cross member 17 has a cylindrical main structure with a circular cross section. The cross member 17 extends along a longitudinal axis 19. In the installed position of the cross member 17, the longitudinal axis 19 is oriented perpendicular to the rotation axis 4 and ideally intersects said rotation axis. A first tenon 20 and a second tenon 21 are formed at the ends by reducing the cross section of the cross member 17. The two tenons 20, 21 have substantially blade-like structures, so that said tenons can be inserted into correspondingly dimensionally complementary slots 24, 25, as a result of which rotation of the cross member 17 about its longitudinal axis 19 is prevented. Threaded bores are made in the cross member 17 at the end of the first tenon 20 and in the end of the second tenon 21, in each case in alignment with the longitudinal axis 19, so that the cross member 17 can be clamped to the first hollow body 5 by means of bolts 18. In the present case, flattened areas are provided centrally on the cross member 17. In the present case, these flattened areas are made by removing material from the circular-cylindrical structure of the main body of the cross member 17. A flat stop face 22 to which the first switching contact piece 11 can be screw-connected is formed in this way. To this end, a passage bore is arranged in the flat stop face 22, it being possible for a bolt which engages into an end-side threaded bore in the first switching contact piece 11 and clamps said first switching contact piece to the flat stop face 22 to pass through said passage bore.

Figure 4:
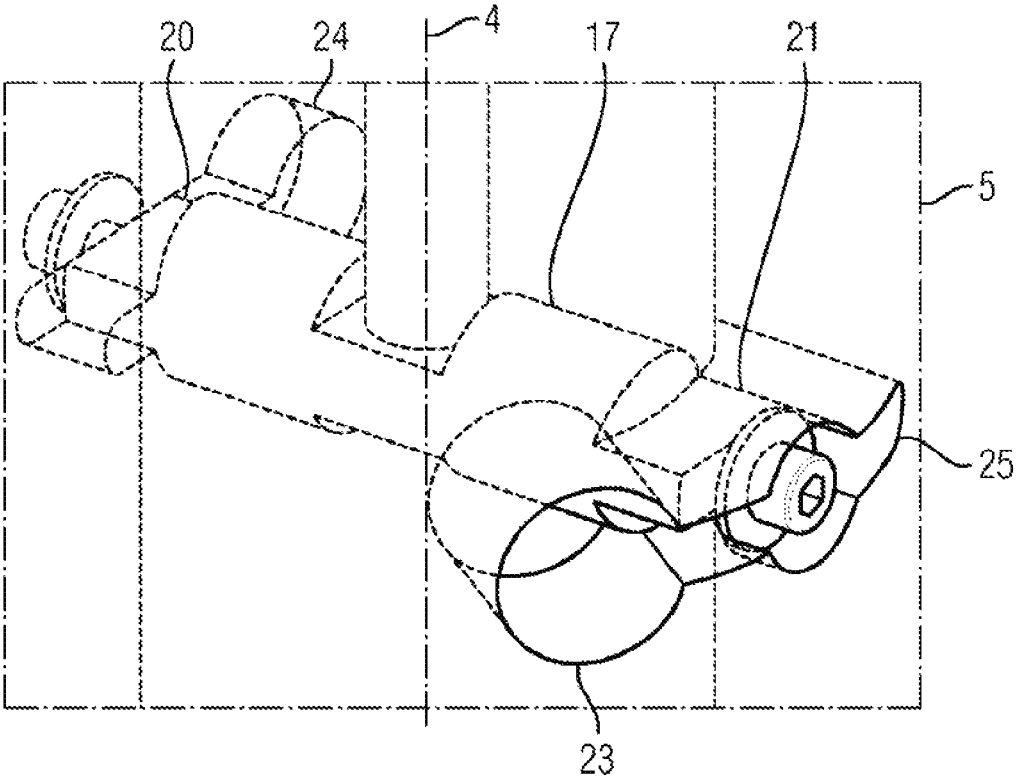
FIG. 4 shows a detail of a possible way of connecting the cross member and the hollow body.

Mounting of a cross member 17 on a first hollow body 5 will be described in greater detail below with reference to FIG. 4. A recess 23 is made in the lateral surface of the hollow-cylinder wall of the first hollow body 5. The recess 23 is oriented in a substantially radial manner and has a cross section which corresponds to the cross section of the cross member 17. In the present case, a circular cross section which is formed in a dimensionally complementary manner in relation to the circular-cylindrical main body of the cross member 17 is selected. It is possible to move the cross member 17 from the radial direction into the interior of the first hollow body 5 via the recess 23. A slot 24 (alternatively an identical recess) which runs in the circumferential direction of the first hollow body 5 is made in the first hollow body 5 diametrically opposite the recess 23. It is therefore possible for the first tenon 20 to project into the first slot 24 after passing the recess 23. A second slot 25 which opens out into the recess 23 is provided diametrically opposite to and in alignment in the circumferential direction with the first slot 24. It is therefore possible, after the first tenon 20 is inserted into the first slot 24, for the second tenon 21 of the cross member 17, which second tenon is now located in the region of the recess 23, to be pivoted over from the recess 23 into the second slot 25 by a pivoting movement which takes place about the rotation axis 4 of the first hollow body 5. This is followed by a corresponding pivoting movement of the first tenon 20 in the first slot 24. As an alternative, provision can also be made for the first slot 24 to serve merely as a counterbearing in order to allow the cross member 17 to pivot and to permit the second tenon 21 to enter the second slot 25. In this case, a pivoting movement preferably takes place about a bearing point in the first slot 24.

Both the first tenon 20 and the second tenon 21 each merge with a shoulder at their base, said shoulders each being in the form of a segment of a circle owing to the shaping of the main body of the cross member 17. Said shoulders bear against the inner wall of the first hollow body 5, which inner wall is delimited by the two slots 24, 25. In the present case, provision is made on the outer lateral surface for the slots 24, 25 to be recessed or widened within a subsection over their profile, so that bolt heads can be positioned within the widened portion such that they are dielectrically shielded. In this case, the bolts 18 are supported against the body edges which delimit the slots 24, 25. As an alternative, provision can also be made for recessing of the bolt heads to be dispensed with, so that the bolt heads of the screw connection of the cross member 17 are screw-connected such that they lie on the outer lateral surface of the first hollow body 5. By screw-connecting the two tenons 20, 21, the cross member 17 is clamped between diametrically opposite flat sections of the first hollow body 5. As an alternative, a cross member 17 can also be secured on one side by, for example, a screw-connection being made only at only one of the tenons 20, 21. In this way, the cross member 17 is fixed on one side, this being advantageous in respect of compensating for thermal expansion phenomena.

The invention claimed is:

1. A switching arrangement, comprising:

an interrupter unit having first and second switching contact pieces movably disposed relative to one another for completing a switching path;

at least one of said first and second switching contact pieces being positioned within a hollow body;

a cross member supporting said at least one switching contact piece in said hollow body, said cross member crossing said hollow body and being braced against opposite sections of said hollow body; and said hollow body having a recess formed in a lateral surface thereof enabling said cross member to be inserted into an interior of said hollow body through said recess, whereupon a tenon of said cross member is pivoted into a slot formed in said hollow body.

2. The switching arrangement according to claim 1, wherein said hollow body is a rotationally symmetrical hollow body.

3. The switching arrangement according to claim 1, wherein said hollow body is a hollow cylinder.

4. The switching arrangement according to claim 3, wherein said cross member extends on a diameter of said hollow body.

5. The switching arrangement according to claim 3, wherein said first switching contact piece is rod-shaped and extends coaxially with a cylinder axis of said hollow cylinder.

6. The switching arrangement according to claim 1, wherein said first switching contact piece has an end seated on said cross member.

7. The switching arrangement according to claim 1, wherein said cross member and said first switching contact piece are screw-connected to one another.

8. The switching arrangement according to claim 1, wherein said cross member is screw-connected to said hollow body from a radial direction.

9. The switching arrangement according to claim 1, wherein said cross member is connected to said hollow body by a tenon and mortise joint.

10. The switching arrangement according to claim 1, which comprises a bolt clamped with said cross member to be supported against cheeks of the slot.

11. The switching arrangement according to claim 1, wherein the slot opens out into said recess.

12. A method of mounting a cross member in an interior of a hollow body of an interrupter unit, the cross member being configured for supporting a switching contact piece of an interrupter unit of a switching arrangement in the interior of the hollow body, the method comprising:

providing the cross member with a tenon;

inserting the cross member into the interior of the hollow body through an opening formed in a lateral surface of the hollow body, the opening extending in a direction that is inclined relative to a final installation position of the cross member in the hollow body; and pivoting the cross member inside the hollow body and inserting a tenon of the cross member into a slot in the hollow body.

13. The method according to claim 12, which comprises rotating the cross member about a rotation axis of the hollow body.

14. The method according to claim 12, which comprises clamping the cross member to the slot.

15. A switching arrangement, comprising:

an interrupter unit having first and second switching contact pieces movably disposed relative to one another for completing a switching path;

at least one of said first and second switching contact pieces being positioned within a hollow body;

a cross member supporting said at least one switching contact piece in said hollow body, said cross member having a main body with a cylindrical cross section reaching across said hollow body from one side to an opposite side thereof and said cross member having at least one end formed with a reduced cross section engaging in a slot formed in a sidewall of said cylindrical main body.

16. The switching arrangement according to claim 15, wherein said said hollow body has a recess formed in a lateral surface thereof enabling said cross member to be inserted in a direction that is inclined relative to a rotation axis of said switching contact pieces and, after insertion into said hollow body, to be pivoted into an installed position perpendicular to the rotation axis.

* * * * *